United States Patent [19]

Hokama et al.

[11] Patent Number: 5,044,384

[45] **Date of Patent: * Sep. 3, 1991**

[54] METHOD OF ACCOMPLISHING RAPID AND DURABLE MANICURE

[75] Inventors: Yosh Hokama, Torrance; Luis Romero, Lawndale, both of Calif.

[73] Assignee: International Beauty Distributors, Inc., Gardena, Calif.

[ * ] Notice: The portion of the term of this patent subsequent to Aug. 30, 2005 has been disclaimed.

[21] Appl. No.: 573,327

[22] Filed: Aug. 27, 1990

Related U.S. Application Data

[63] Continuation-in-part of Ser. No. 66,267, Jun. 25, 1987, Pat. No. 4,767,648, and a continuation of Ser. No. 197,630, May 23, 1988, abandoned.

[51] Int. Cl.[5] ..... A45D 24/00

[52] U.S. Cl. ..... 132/200; 132/73

[58] Field of Search ..... 132/73, 200, 285

[56] References Cited

U.S. PATENT DOCUMENTS

| | | | |
|---|---|---|---|
| 2,688,331 | 9/1954 | Bogoslowsky | 132/73 |
| 2,816,555 | 12/1957 | Klump | 132/73 |
| 3,598,685 | 8/1971 | Lee et al. | 132/73 |
| 3,885,578 | 5/1975 | Hicks | 132/73 |
| 3,898,357 | 8/1975 | Miller et al. | 132/73 |
| 4,627,453 | 12/1986 | Isler | 132/73 |
| 4,767,648 | 8/1988 | Hokama et al. | 132/73 |
| 4,860,774 | 8/1989 | Becker | 132/73 |

FOREIGN PATENT DOCUMENTS

| | | | |
|---|---|---|---|
| 0226077 | 12/1984 | Japan | 132/73 |
| 0559019 | 2/1975 | Switzerland | 132/73 |
| 2111431 | 7/1983 | United Kingdom | 132/73 |

*Primary Examiner*—Cary E. Stone
*Assistant Examiner*—Adriene B. Lepiane
*Attorney, Agent, or Firm*—William W. Haefliger

[57] ABSTRACT

A method for rapidly accomplishing a durable manicure, that includes the steps:

a) providing a flexible tab having a protective and separable upper layer, and a durable lower layer, the tab having the shape of a fingernail forward tip portion, b) applying and adhering the tab lower layer to the fingernail forward tip portion so that the tab extends proximate the forward edge of the fingernail forward tip portion, c) then peeling off the tab upper layer, thereby to expose the lower layer which has an upper surface, d) whereby the fingernail has an upwardly exposed upper surface of selected finish on the lower layer, and at its forward tip portion.

10 Claims, 2 Drawing Sheets

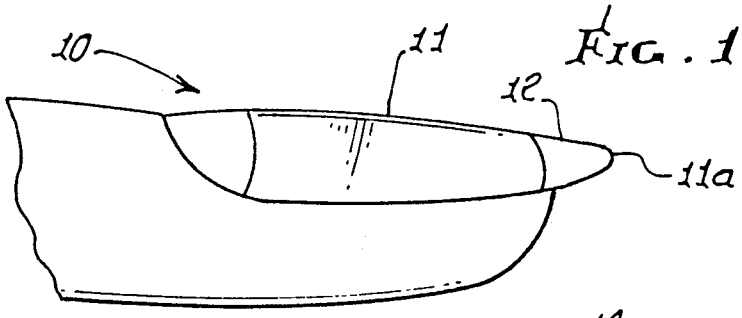
FIG. 1.
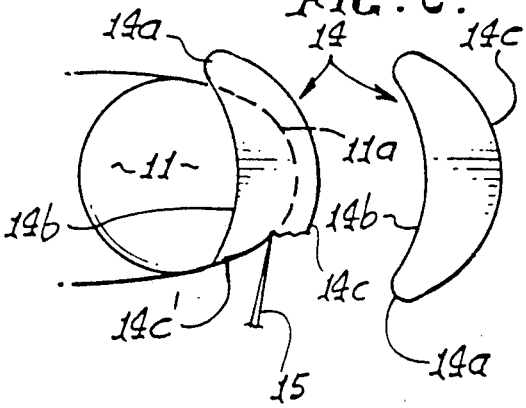
FIG. 2.
FIG. 3a.
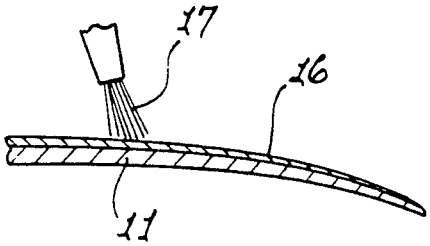
FIG. 3b.
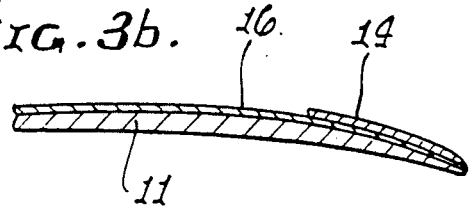
FIG. 3c.
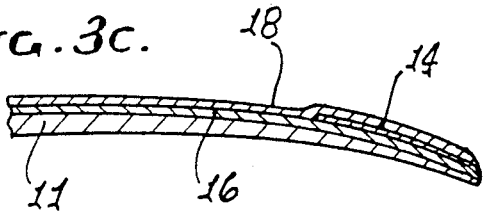
FIG. 2a.
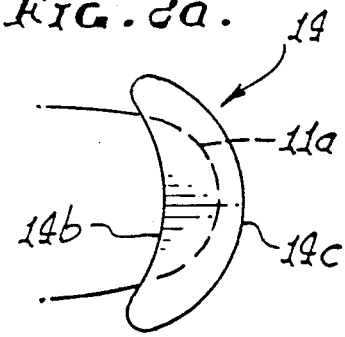
FIG. 4.
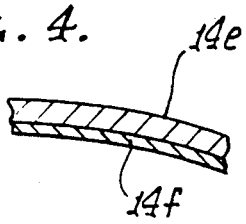
FIG. 5.
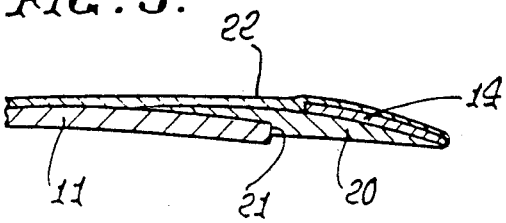
FIG. 6.
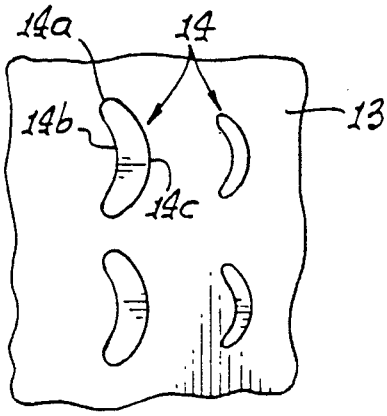

FIG. 7a.
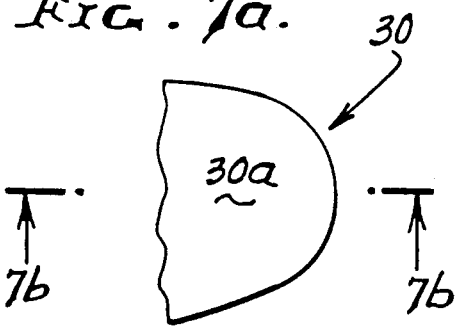
FIG. 7b.
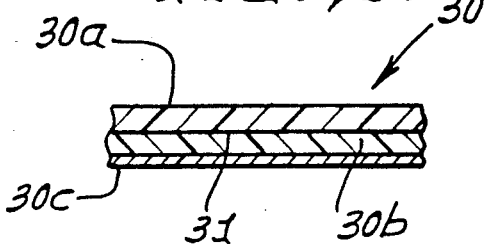
FIG. 8b.
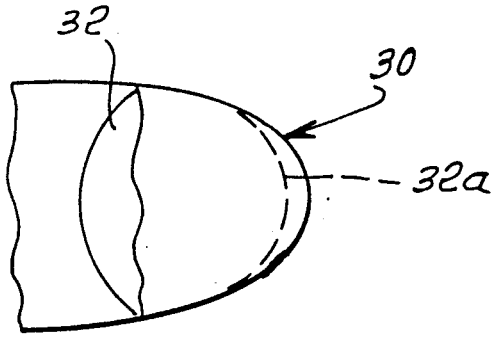
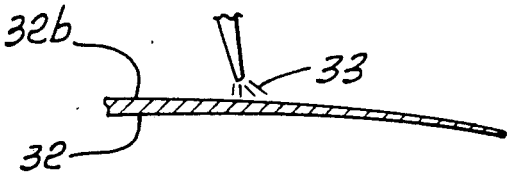
FIG. 8.
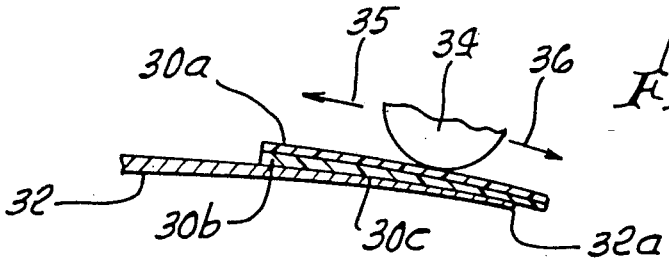
FIG. 8a.
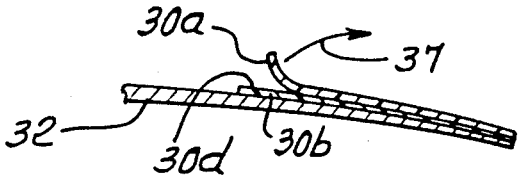
FIG. 9.
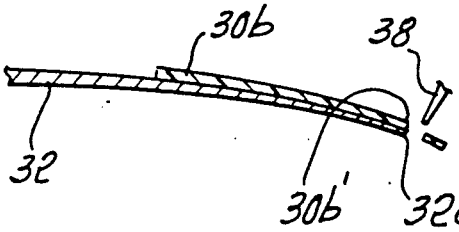
FIG. 10.

METHOD OF ACCOMPLISHING RAPID AND DURABLE MANICURE

This application is a continuation-in-part of Ser. No. 066,267, filed June 25, 1987, now U.S. Pat. No. 4,767,648, issued Aug. 30, 1988, and a continuation of Ser. No. 197,630, filed May 23, 1988, abandoned.

BACKGROUND OF THE INVENTION

This invention relates generally to manicure processes. Ser. No. 066,267 filed June 25, 1987, now U.S. Pat. No. 4,767,648 issued Aug. 30, 1988 and a continuation of Ser. No. 197,63 filed May 23, 1988, abandoned.

At the present time, a french manicure as accomplished by manicurists has certain disadvantages. One of them is the length of time required to produce a cured white tip on the fingernail. The white tip consists of a white lacquer application for the nail tip, and up to one-half hour is required for curing or drying of the lacquer before nail polish can be overlaid onto the dried white tip. Another disadvantage is the tendency of the white tip to chip or wear, with time. A further disadvantage is the need for a bulky bottle containing the white lacquer to be applied to the nail tip. There is need for a process which avoids the above problems and disadvantages.

Further, it is desirable to provide a nail strengthening manicure and at the same time protect the manicurists' fingers from contact with adhesive soaking into the nail strengthening fabric.

SUMMARY OF THE INVENTION

It is a major object of the invention to provide manicure processes which meet the above needs.

Further advantages include the provision of a manicure process wherein the application of the white tip is rapid, and does not require drying or curing of lacquer; and the provision of a durable white tip.

The above advantages and objects are, according to one aspect of the invention, embodied in a process that includes the steps:

a) providing a flexible tab having a white or near-white upper surface that is compatible to nail polish, the tab having the shape of an over-sized fingernail forward tip portion, b) applying and adhering the tab to the fingernail forward tip portion so that the tab has extent beyond the forward edge of the fingernail forward tip portion, c) then trimming off said tab extent beyond the forward edge of the fingernail forward tip portion, d) then applying translucent liquid nail polish to the fingernail upper surface and to cover said tab upper surface, and allowing the polish to dry, e) whereby the fingernail has a glossy upper surface that is white or near-white only at its forward up portion.

Additionally, and as will appear, the method may include initially applying a liquid primer coating to the fingernail upper surface, and allowing that coating to dry, whereby the tab is adherent to the coating.

Further, an adhesive may be provided between the tab and the fingernail forward portion; and in this regard, the tab may be provided with a pressure-sensitive adhesive under surface. Said adhering step comprises pressing the tab under surface onto the fingernail forward tip portion so that said adhesive under surface adheres thereto.

Also, and typically, multiple of said tabs are provided, and steps b) through d) are repeated for each of the fingernails on a human hand; and in this regard, a carrier sheet may be provided on which different size tabs are removably carried, and including selectively removing the tabs from said sheet at the time of tab application to the fingernail forward tip portion.

A second aspect of the invention includes a nail strengthening process, that includes the steps:

a) providing a flexible tab having a protective and separable upper layer, and a durable lower layer, the tab having the shape of a fingernail forward tip portion, b) applying and adhering the tab lower layer to the fingernail forward tip portion so that the tab extends proximate the forward edge of the fingernail forward tip portion, c) then peeling off said tab upper layer, thereby to expose the lower layer which has an upper surface;

d) whereby the fingernail has an upwardly exposed upper surface of selected finish on said lower layer, and at its forward tip portion.

These and other objects and advantages of the invention will be more fully understood from the following description and drawings, in which:

DRAWING DESCRIPTION

FIG. 1 is a side elevation showing a finger and fingernail;

FIG. 2 is a top plan view of a fingernail showing steps of the process;

FIG. 2*a* is a view like FIG. 2 showing a modification; FIGS. 3*a*, 3*b* and 3*c* are enlarged elevations, in section, showing steps of the process;

FIG. 4 is a further enlarged fragmentary elevation, in section, showing a french manicure tab, and adhesive;

FIG. 5 is a view like FIG. 3*c*, showing application of the invention to an artificial fingernail, or nail tip;

FIG. 6 is a fragmentary view of a carrier sheet carrying multiple of the tabs, of different sizes;

FIG. 7*a* is a plan view of a nail strengthening tab;

FIG. 7*b* is an enlarged section on lines 7*b*—7*b* of FIG. 7*a*;

FIG. 8 shows liquid primer or adhesive on a nail;

FIG. 8*a* shows tab application to the nail, after adhesive application;

FIG. 8*b* is a plan view showing tab positioning; FIG. 9 is a section view like FIG. 8*a*, showing peel off of tab upper layer; and FIG. 10 shows cured in situ tab lower layer, and trimming.

DETAILED DESCRIPTION

In FIG. 1, a human finger or digit 10 has a fingernail 11. A French manicure normally involves application of a white upper tip 12 to the nail or by carefully brushing on a crescent-shaped configuration, or for example may consist of white enamel which requires up to one-half hour cure or drying time. This is time consuming and relatively expensive in manicurist's time, considering ten applications to fingernails and thumb-nails of both hands.

FIG. 6 shows a carrier sheet 13 on which a number of different size, crescent-shaped flexible, thin sheet-like tabs 14 are loosely carried, to be easily selected and removed, one by one. For example, the tabs may consist of synthetic resin, such as MYLAR, or the like of thickness between 0.003 and 0.015 inch. Other materials are usable. The tabs have arcuate corners at 14*a*, joining rearward and forward crescent-shaped edges 14b and 14c, as in FIG. 2. The tab is intended to be applied to a fingernail forward portion to overhang its forward edge 11a, and for this purpose the tab has the general shape of an oversized fingernail forward tip portion. This allows adjustment in the intended size of the resultant french manicure tip; for example, edge 14b may be applied to the fingernail in further-back position as seen in FIG. 2a, yielding a resultant larger french manicure tip.

After press-down adherence of the tab to the nail forward tip portion, the tab excess (beyond the nail forward edge 11a trimmed away, as by a scissors or blade, indicated at 15 in FIG. 2, thereby shaping the forward edge 14c' of the tab to conform to the forward edge 11a of the nail. Thereafter, translucent liquid nail polish may be applied to the tip surface 11b of the nail, and to the tip surface 14d of the tab, to cover said surface or surfaces, yielding after cure a fingernail glossy upper surface which is white or near-white only at the tab-covered forward tip portion. The cured hard layer of polish also protects the tab, and its application to the forward edges 11a and 14c', bonds them together and protects them.

FIG. 3 shows multiple steps of a process embodying the invention. In FIG. 3a, a thin protective liquid primer coating 16 is applied to the entire upper surface of the nail 11, as by a brush 17. After rapid cure of the coating 16, the tab 14 is applied and adhered to the coating covering the nail forward tip portion, and the tab excess is trimmed away, as described, yielding the FIG. 3b configuration. This step requires only about a minute or two. Thereafter, liquid polymer nail polish 18 is applied in a thin coating over the upper surface of the coating 16 and over the upper surface of the tab 14, and the polish allowed to cure. As a result, the nail has a glossy, attractive upper surface that is white or near-white (or other color) only at its forward tip portion, the tab 14 also offering protection to the nail forward portion.

FIG. 4 shows the tab to consist of a flexible sheet 14e (MYLAR or the like), and a pressure-sensitive adhesive under layer 14f adapting the tab to be applied to the nail press-on technique. Such pressure-sensitive adhesives are well known. Alternatively, a glue may be applied between the tab and the nail or primer coat surface to quickly adhere the tab to the nail. One such glue is the product marketed under the name "CRAZY GLUE".

FIG. 5 shows the tab 14 applied to the forwardmost upper surface extent of an artificial fingernail, or nail tip 20. The latter is attached to the natural nail 11, as at interface 21, quick drying glue being used for that purpose. Nail polish coating 22 covers the upper surfaces of the nail 11, nail 20, and tab 14, providing a dressy and protective french manicure to an artificial nail or nail top extending previously from a natural nail.

FIGS. 7-10 show an alternate method of rapidly accomplishing a durable nail strengthening manicure. In FIGS. 7a and 7b, a flexible tab 30 is provided, the tab having a separable upper layer 30a and a durable lower layer 30b, the tab having the shape of a fingernail forward tip portion. Layers 30a and 30b are lightly adherent to one another at 31, and separable by peeling layer 30a off layer 30b. Lower layer 30b typically consist of porous fabric such as Linen, silk, fiberglass, or paper, and flexible upper layer 30a typically consists of synthetic resin, such as MYLAR, or the like. Light adhesive at interface 31 is such as to permit ultimate peel-away of layer 30a and may be of the type commonly used for lightly adhering the under layer of a BAND AID composite to the flexible plastic over layer of the composite. Fabric 30b is porous so as to absorb liquid glue or adhesive. Each layer 30a and 30b has thickness less than 0.030 inches, and typically the thickness of layer 30a is 0.005 inches and the thickness of layer 30b is 0.005 inches.

Next, the composite tab lower layer 30b is applied to and adhered to the fingernail forward tip portion (natural nail or artificial nail) 32, so that the tab extends proximate the formed edge 32a of the tip portion 32. It may overhang that edge, as appears in FIG. 8a and 8b. In this regard, a liquid primer coating may be applied to the fingernail upper surface 32b, as shown at 33 in FIG. 8, and that coating is allowed to dry, whereby the tab is adherent to that coating when applied to the nail. Also, or alternatively, quick dry adhesive (such as CRAZY GLUE) is applied at the tab under surface 30c, FIG. 8 showing application of the adhesive at 33 in a layer onto the upper surface of the nail forward tip portion. The tab is then positioned on and adhered to the nail, as by pressing and maneuvering the tab under surface 30c onto the tip portion 32 so that the tab is positioned as in FIG. 8b and adhere to the nail. FIG. 8a shows the manicurist's finger 34 moving in one or both directions 35 and 36 to manuever the tab on the nail, as the finger 34 pushes the tab onto the nail. The flexible fabric layer 30b is thereby kept smooth as positioning of the tab and curing of the adhesive occurs, the adhesive also in part penetrating into the porosity of the fabric. Plastic upper layer 30a at the same time protects the user's finger 34 from contact with the adhesive soaking into the fabric.

The undersurface 30c of the fabric layer may also be provided with a pressure resistive adhesive layer, as for example at spaced apart locations, to assist in adhering the tab to the nail.

After curing of the glue or adhesive applied at 33 to the nail and soaking into the layer 30c (say for example after about 30 seconds following maneuvering of the tab into FIG. 8b portion), the tap upper layer ;s peeled off, thereby to expose the smooth upper surface 30d of the lower layer, as in FIG. 9. See peel direction 37 in FIG. 9. Finally, the adherent lower layer 30b is trimmed, as by a scissors 38 in FIG. 10 to conform its formed edge 30b' to the nail forward edge 32a.

The natural or artificial nail 32 is thereby greatly strengthened by the adherent fabric layer 30b, cured in situ. Also, the nail upper surface is protected from nail polish subsequently applied to the upper surface 30d of the fabric layer 30b.

Multiple of such tabs 10 may be supplied and in different sizes, on a carrier sheet, in the same manner as described in connection with FIG. 6.

We claim:

1. A method of rapidly accomplishing a durable manicure, that includes the steps:

a) forming and providing a generally crescent shaped, flexible tab having a protective and separable upper layer, and adjacent thereto a durable lower layer providing a smooth upper surface, the tab having the shape of a fingernail forward tip portion, the tab being oversize in relation to the fingernail forward tip portion, the tab lower layer selected from the group consisting of porous fabric and paper, and the tab upper layer consisting of a sheet of synthetic resin having thickness between 0.003 and 0.015 inches, b) applying a liquid primer coating to the fingernail upper surface, and allowing that coating to dry, and applying and adhering the tab lower layer only to the said coating at the fingernail forward tip portion so that the crescent-shaped tab has extent beyond the forward edge of the fingernail forward tip portion, and so that said coating is openly exposed rearwardly of said tab, c) then peeling off said tab upper layer from said lower layer, thereby to expose the tab lower layer smooth upper surface and to expose a rearward edge defined by said tab lower layer, d) then trimming off the tab lower layer extent at the forward edge of the fingernail forward tip portion, e) whereby the fingernail forward tip portion has an upwardly exposed upper smooth surface of selected finish on said tab lower layer, and only at its forward tip portion, f) and applying nail adherent protective liquid to and over said upper smooth surface and to and over said exposed primer coating, to protect the tab and its said rearward edge.

2. The method of claim 1 wherein said adhering step is carried out by pressing an adherent under surface of the lower layer onto the fingernail forward tip portion.

3. The method of claim 1 wherein said resin sheet consists of MYLAR or the like.

4. The method of claim 1 including providing the tab with a pressure-sensitive adhesive under surface, and said adhering step includes pressing the tab under surface onto said dried coating on the fingernail forward tip portion so that said adhesive adheres thereto.

5. The method of claim 1 including providing an adhesive between the tab and the dried coating on the fingernail forward tip portion.

6. The method of any one of claims 2 or 5 wherein said adhesive consists of glue or the like.

7. The method of claim 1 wherein multiple of said tabs are provided, said steps b) through e) are repeated for each of the fingernails on a human hand, as follows:

b) applying and adhering the tab lower layer to the fingernail forward tip portion so that the tab has extent beyond the forward edge of the fingernail forward tip portion, c) then peeling off said tab upper layer from said lower layer, thereby to expose the lower layer smooth upper surface, d) then trimming off the tab lower layer extent beyond the forward edge of the fingernail forward tip portion, e) whereby the fingernail has an upwardly exposed upper smooth surface of selected finish on said tab lower layer, and at its forward tip portion.

8. The method of claim 7 including providing a carrier sheet on which said tabs are removably carried, and including selectively removing the tabs from said sheet at the time of tab application to the fingernail forward tip portion.

9. The method of claim 1 wherein said fingernail is a natural fingernail.

10. The method of claim 1 wherein the fingernail is an artificial fingernail.

* * * * *